US007912719B2

(12) United States Patent
Hirose

(10) Patent No.: US 7,912,719 B2
(45) Date of Patent: Mar. 22, 2011

(54) SPEECH SYNTHESIS DEVICE AND SPEECH SYNTHESIS METHOD FOR CHANGING A VOICE CHARACTERISTIC

(75) Inventor: Yoshifumi Hirose, Kyoto (JP)

(73) Assignee: Panasonic Corporation, Osaka (JP)

( * ) Notice: Subject to any disclaimer, the term of this patent is extended or adjusted under 35 U.S.C. 154(b) by 1169 days.

(21) Appl. No.: 11/579,899

(22) PCT Filed: Apr. 1, 2005

(86) PCT No.: PCT/JP2005/006489

§ 371 (c)(1),
(2), (4) Date: Nov. 8, 2006

(87) PCT Pub. No.: WO2005/109399

PCT Pub. Date: Nov. 17, 2005

(65) Prior Publication Data

US 2007/0233489 A1 Oct. 4, 2007

(30) Foreign Application Priority Data

May 11, 2004 (JP) ..... 2004-141551

(51) Int. Cl.
*G10L 13/00* (2006.01)
*G10L 13/08* (2006.01)

(52) U.S. Cl. ..... 704/260; 704/258

(58) Field of Classification Search ..... 704/258, 704/260

See application file for complete search history.

(56) References Cited

U.S. PATENT DOCUMENTS 6,363,342 B2 * 3/2002 Shaw et al. ..... 704/220
6,529,874 B2 * 3/2003 Kagoshima et al. ..... 704/269
6,829,581 B2 * 12/2004 Meron ..... 704/258
7,412,422 B2 * 8/2008 Shiloh ..... 705/74
7,640,160 B2 * 12/2009 Di Cristo et al. ..... 704/257
2001/0032079 A1 10/2001 Okutani et al.
2002/0007276 A1 * 1/2002 Rosenblatt et al. ..... 704/260
2003/0028380 A1 * 2/2003 Freeland et al. ..... 704/260
2004/0098266 A1 * 5/2004 Hughes et al. ..... 704/277
2004/0225501 A1 * 11/2004 Cutaia ..... 704/260

FOREIGN PATENT DOCUMENTS

JP 7-319495 12/1995
JP 8-248994 9/1996
JP 9-090970 4/1997
JP 10-097267 4/1998
JP 11-085194 3/1999
JP 2001-282278 10/2001

(Continued)

*Primary Examiner* — E. Yen
(74) *Attorney, Agent, or Firm* — Wenderoth, Lind & Ponack, L.L.P.

(57) ABSTRACT

A speech synthesis device, in which the sound quality is not significantly degraded when generating a synthesized sound, includes a target element information generation unit (102), an element database (103), an element selection unit (104), a voice characteristics designation unit (105), a voice characteristics transformation unit (106), a distortion determination unit (108), and a target element information correction unit (109). When the speech element sequence transformed by the voice characteristics transformation unit (106) is determined as distorted by the distortion determination unit (108), the target element information correction unit (109) corrects the speech element information generated by the target element information generation unit (102) to the speech element information of the transformed voice characteristic, and the element selection unit (104) reselects a speech element sequence. Therefore, the synthesized sound of the voice characteristic designated by the voice characteristics designation unit (105) is generated without degrading the sound quality of the synthesized sound.

15 Claims, 9 Drawing Sheets

FOREIGN PATENT DOCUMENTS

| | | |
|---|---|---|
| JP | 2003-029774 | 1/2003 |
| JP | 2003-066982 | 3/2003 |
| JP | 2003-157100 | 5/2003 |
| JP | 2004-053833 | 2/2004 |

* cited by examiner

Voice characteristics space

SPEECH SYNTHESIS DEVICE AND SPEECH SYNTHESIS METHOD FOR CHANGING A VOICE CHARACTERISTIC

TECHNICAL FIELD

The present invention relates to a speech synthesis device, in particular, to a speech synthesis device that reproduces a voice characteristic specified by an editor, and continuously changes the voice characteristic when the specified voice characteristic is continuously changed.

BACKGROUND ART

Conventionally, a system that transforms a voice characteristic so as to match the voice characteristic inputted for a speech element sequence selected by an element selection unit is proposed as a speech synthesis system capable of synthesizing speech and changing the voice characteristic of the synthesized sound (for example, Patent Reference 1).

FIG. 9 is a configuration diagram of a conventional voice characteristics variable speech synthesis device described in Patent Reference 1. The conventional voice characteristics variable speech synthesis device includes a text input unit 1, a voice characteristics transformation parameter input unit 2, an element storage unit 3, an element selection unit 4, a voice characteristics transformation unit 5, and a waveform synthesis unit 6.

The text input unit 1 is a processing unit that externally accepts phoneme information indicating a content of a word requested to be speech synthesized and prosody information indicating an accent and an intonation of an entire speech, and outputs them to the element selection unit 4.

The voice characteristics transformation parameter input unit 2 is a processing unit that accepts the input of a transformation parameter required for transformation to the voice characteristic desired by the editor. The element storage unit 3 is a storage unit that stores speech elements for various speeches. The element selection unit 4 is a processing unit that selects, from the element storage unit 3, the speech element sequence that most matches the phoneme information and the prosody information outputted from the text input unit 1.

The voice characteristics transformation unit 5 is a processing unit that transforms the speech element sequence selected by the element selection unit 4 into the voice characteristic desired by the editor, using the transformation parameter inputted by the voice characteristics transformation parameter input unit 2. The waveform synthesis unit 6 is a processing unit that synthesizes a speech waveform from the speech element with the voice characteristic which is transformed by the voice characteristics transformation unit 5.

Thus, in the conventional voice characteristics variable speech synthesis device, the voice characteristics transformation unit 5 transforms the speech element sequence selected by the element selection unit 4 using the speech transformation parameter inputted by the voice characteristics transformation parameter input unit 2 to obtain a synthesized sound of the voice characteristic desired by the editor.

In addition, a method of performing voice characteristics variable speech synthesis by preparing a plurality of speech element databases for each voice characteristic, and selectively using the speech element database that most matches the inputted voice characteristic is known.

Patent Reference 1: Japanese Laid-Open Patent Application No. 2003-66982 (pp. 1-10, FIG. 1)

DISCLOSURE OF INVENTION

Problems that Invention is to Solve

However, in the former voice characteristics variable speech synthesis device, the voice characteristic desired by the editor sometimes greatly differs from the voice characteristic of the speech element having a standard voice characteristic (neutral voice characteristic) stored in the element storage unit 3. Thus, when the voice characteristic of the speech element sequence selected by the element storage unit 3 greatly differs from the voice characteristic designated by the voice characteristics transformation parameter input unit 2, it becomes necessary to very greatly deform the speech element sequence selected by the voice characteristics transformation unit 5. Thus, there is a problem that the sound quality significantly lowers when generating the synthesized sound in the waveform synthesis unit 6.

On the other hand, in the latter method, the voice characteristics transformation is performed by changing the speech element database. However, the number of speech element databases is a finite number. Thus the voice characteristics transformation becomes discrete, causing a problem that the voice characteristic cannot be continuously changed.

The present invention aims at solving the above problems, and it is a first object to provide a speech synthesis device in which sound quality is not significantly lowered when generating a synthesized sound.

In addition, it is a second object to provide a speech synthesis device that can continuously change the voice characteristic of the synthesized sound.

DISCLOSURE OF INVENTION

Problems that Invention is to Solve

In order to solve the conventional problems, the speech synthesis device according to the present invention is a speech synthesis device which synthesizes a speech having a desired voice characteristic and includes: a speech element storage unit for storing speech elements of plural voice characteristics; a target element information generation unit which generates speech element information corresponding to language information, based on the language information including phoneme information; an element selection unit which selects, from the speech element storage unit, a speech element sequence corresponding to the speech element information; a voice characteristics designation unit which accepts a designation regarding a voice characteristic of a synthesized speech; a voice characteristics transformation unit which transforms the speech element sequence selected by the element selection unit into a speech element sequence of the voice characteristic accepted by the voice characteristics designation unit; a distortion determination unit which determines a distortion of the speech element sequence transformed by the voice characteristics transformation unit; and a target element information correction unit which corrects the speech element information generated by the target element information generation unit to speech element information corresponding to the speech element sequence transformed by the voice characteristics transformation unit, in the case where the distortion determination unit determines that the transformed speech element sequence is distorted. Here, the element selection unit selects, from the speech element storage unit, a speech element sequence corresponding to the corrected speech element information, in the case where the target element information correction unit has corrected the speech element information.

Here, the distortion determination unit determines a distortion in the speech element sequence of the transformed voice characteristic; in the case where the distortion is large, the target element information correction unit corrects speech element information; and the element selection unit further selects a speech element sequence corresponding to the corrected speech element information. The voice characteristics transformation unit thus can perform voice characteristics transformation based on a speech element sequence of a voice characteristic closer to the voice characteristic designated by the voice characteristics designation unit. Therefore, a speech synthesis device in which sound quality is not significantly degraded when generating a synthesized sound can be provided. Furthermore, the speech element storage unit stores speech elements of plural voice characteristics and voice characteristics transformation is performed based on one of the speech elements. As a result, the voice characteristic of the synthesized sound can be continuously changed even in the case where the voice characteristic is continuously changed by the editor using the voice characteristics designation unit.

Preferably, the voice characteristics transformation unit further transforms the speech element sequence corresponding to the corrected speech element information into the speech element sequence of the voice characteristic accepted by the voice characteristics designation unit.

With this configuration, the transformation into the speech element sequence of the voice characteristic accepted by the voice characteristics designation unit is again performed. Therefore, the voice characteristic of the synthesized sound can be continuously changed by repeating the reselection and retransformation of speech element sequence. In addition, since the voice characteristic is continuously changed as described in the above, the voice characteristic can be significantly changed without degrading the sound quality.

Preferably, the target element information correction unit further adds a vocal tract feature of the speech element sequence transformed by said voice characteristics transformation unit, to the corrected speech element information, when correcting the speech element information generated by the target element information generation unit.

By adding vocal tract information to the corrected speech element information, the element selection unit can select a speech element which is closer to the designated voice characteristic, and generate a synthesized sound with lesser degradation in sound quality and closer to the designated voice characteristic.

Further preferably, the distortion determination unit determines a distortion based on a connectivity between adjacent speech elements.

The distortion is determined based on the connectivity between adjacent speech elements so that a synthesized sound can be obtained smoothly at the time of reproduction.

Further preferably, the said distortion determination unit determines a distortion based on a degree of deformation between the speech element sequence selected by the element selection unit and the speech element sequence transformed by the voice characteristics transformation unit.

The distortion is determined based on a degree of deformation between pre-transformation and post-transformation speech element sequences, so that voice characteristics transformation is performed based on the speech element sequence which is the closest to the target voice characteristic. Therefore, a synthesized sound with lesser degradation in sound quality can be generated.

Further preferably, the element selection unit selects, from the speech element storage unit, the speech element sequence corresponding to the corrected speech element information, only with respect to a range in which the distortion is detected by the distortion determination unit, in the case where the target element information correction unit has corrected the speech element information.

Only the range in which the distortion is detected is targeted for retransformation. Therefore, high-speed speech synthesis can be realized. Whereas there is a possibility of obtaining a synthesized speech having a voice characteristic different from the designated voice characteristic in the case where the portion which is not distorted is also transformed, such possibility is prevented in configuration so that a highly accurate synthesized sound can be obtained.

Further preferably, the speech element storage unit includes: a basic speech element storage unit for storing a speech element of a standard voice characteristic; a voice characteristics speech element storage unit for storing speech elements of plural voice characteristics, the speech elements being different from the speech element of the standard voice characteristic, the element selection unit includes: a basic element selection unit which selects, from the basic speech element storage unit, a speech element sequence corresponding to the speech element information generated by the target element information generation unit; and a voice characteristics element selection unit which selects, from the voice characteristics speech element storage unit, the speech element sequence corresponding to the speech element information corrected by the target element information correction unit.

The first speech element selected is always the speech element sequence of a standard voice characteristic. Therefore, the selection of the first speech element can be performed in high-speed. Furthermore, even in the case where a synthesized sound of various voice characteristics is generated, the convergence is performed in high-speed, so that the synthesized sound can be obtained in high-speed. In addition, speech transformation and speech element selection are always performed starting from a standard speech element sequence. Therefore, there is no mistake of synthesizing a speech which is not intended by the editor, so that a highly accurate synthesized sound can be generated.

It should be noted that the present invention is not only realized as a speech synthesis device having such characteristic steps, but also as a speech synthesis method having the characteristic steps included in the speech synthesis device as steps, as well as a program for causing a computer to function as the units included in the speech synthesis device. Also, it is obvious that such program can be distributed by a recording medium such as a Compact Disc-Read Only Memory (CD-ROM) or through a communication network such as the Internet.

EFFECTS OF THE INVENTION

The speech synthesis device of the present invention can transform the synthesized speech to have a continuous and wide range of voice characteristic desired by the editor without degrading the quality of the synthesized sound, by reselecting a speech element sequence from the element database according to the distortion of a speech element sequence when transforming the voice characteristic.

NUMERICAL REFERENCES

Figure 1:
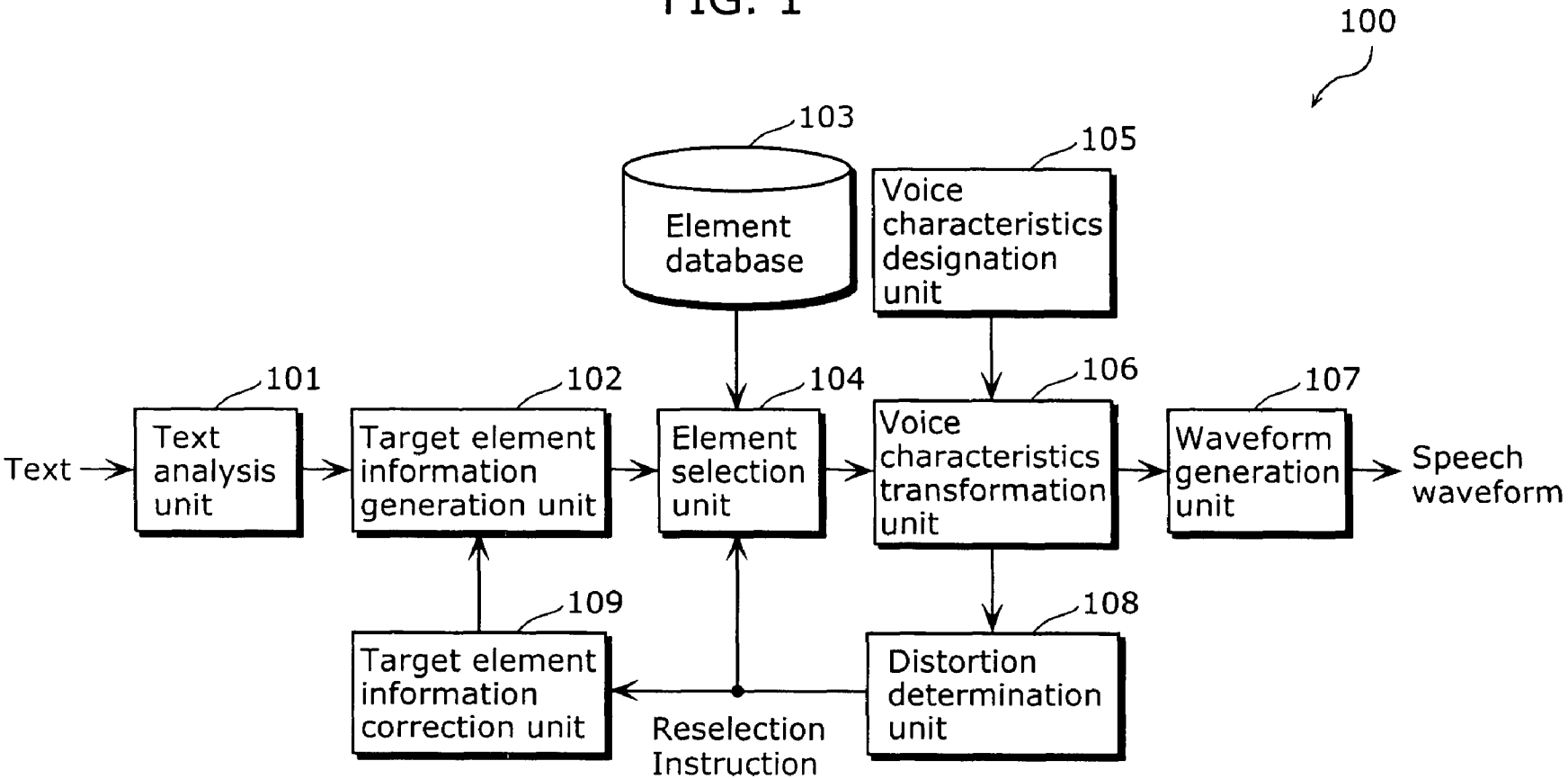
FIG. 1 is a configuration diagram of a voice characteristics variable speech synthesis according to a first embodiment of the present invention.

101 text analysis unit
102 target element information generation unit
103 element database
104 element selection unit
105 voice characteristics designation unit
106 voice characteristics transformation unit
107 waveform generation unit
108 distortion determination unit
109 target element information correction unit
201 basic element database
202 voice characteristics element database
301 element candidate extraction unit
302 search unit
303 cost calculation unit
304 target cost calculation unit
305 connection cost calculation unit
801 element holding unit

BEST MODE FOR CARRYING OUT THE INVENTION

The following describes embodiments of the present invention with reference to the drawings.

First Embodiment

FIG. 1 is a configuration diagram of a voice characteristics variable speech synthesis device according to a first embodiment of the present invention. A voice characteristics variable speech synthesis device 100 is a device that synthesizes a speech having a voice characteristic desired by the editor, and includes a text analysis unit 101, a target element information generation unit 102, an element database 103, an element selection unit 104, a voice characteristics designation unit 105, a voice characteristics transformation unit 106, a waveform generation unit 107, a distortion determination unit 108, and a target element information correction unit 109.

The text analysis unit 101 linguistically analyzes an externally inputted text and outputs morpheme information and phoneme information. The target element information generation unit 102 generates speech element information such as phonological environment, fundamental frequency, duration length, power and the like based on language information including the phoneme information analyzed by the text analysis unit 101. The element database 103 stores the speech elements, each of which is a previously recorded sound labeled in units of phoneme and the like.

The element selection unit 104 selects the most suitable speech element sequence from the element database 103 based on the target speech element information generated by the target element information generation unit 102. The voice characteristics designation unit 105 accepts designation on the voice characteristic of the synthesized sound desired by the editor. The voice characteristics transformation unit 106 transforms the speech elements selected by the element selection unit 104 so as to match the voice characteristic of the synthesized sound specified by the voice characteristics designation unit 105.

The waveform generation unit 107 generates a speech waveform from the speech element sequence that has been transformed by the voice characteristics transformation unit 106, and outputs the synthesized sound. The distortion determination unit 108 determines the distortion of the speech element sequence with the voice characteristic transformed by the voice characteristics transformation unit 106.

The target element information correction unit 109 corrects target element information used for element selection performed by the element selection unit 104 to the speech element information of the speech element transformed by the voice characteristics transformation unit 106 when the distortion of the speech element sequence determined by the distortion determination unit 108 exceeds a predetermined threshold value.

Next, the operations of each unit are described.

<Target Element Information Generation Unit 102>

The target element information generation unit 102 predicts the prosody information of the inputted text based on the language information sent from the text analysis unit 101. The prosody information includes duration length, fundamental frequency, and power information for at least every phoneme unit. Other than the phoneme unit, the duration length, the fundamental frequency, and the power information may be predicated for every unit of mora or syllable. The target element information generation unit 102 may perform prediction of any method. For example, prediction may be performed with a method according to quantification type I.

<Element Database 103>

The element database 103 stores an element of the speech recorded in advance. The form of storing may be a method of storing a waveform itself, or may be a method of separately storing the sound source wave information and the vocal tract information. The speech element to be stored is not limited to the waveform, and the re-synthesizable analysis parameter may be stored.

The element database 103 stores not only the speech element, but also the features used for selecting the stored element for every element unit. The element unit includes a phoneme, a syllable, a mora, a morpheme, a word, and the like and is not particularly limited.

Information such as phonological environment before and after the speech element, fundamental frequency, duration length, power, and the like is stored as the basic features used for element selection.

In addition, detailed features include a formant pattern, a cepstrum pattern, a temporal pattern of a fundamental frequency, a temporal pattern of power, and the like, which are features of the spectrum of the speech element.

<Element Selection Unit 104>

Figure 2:
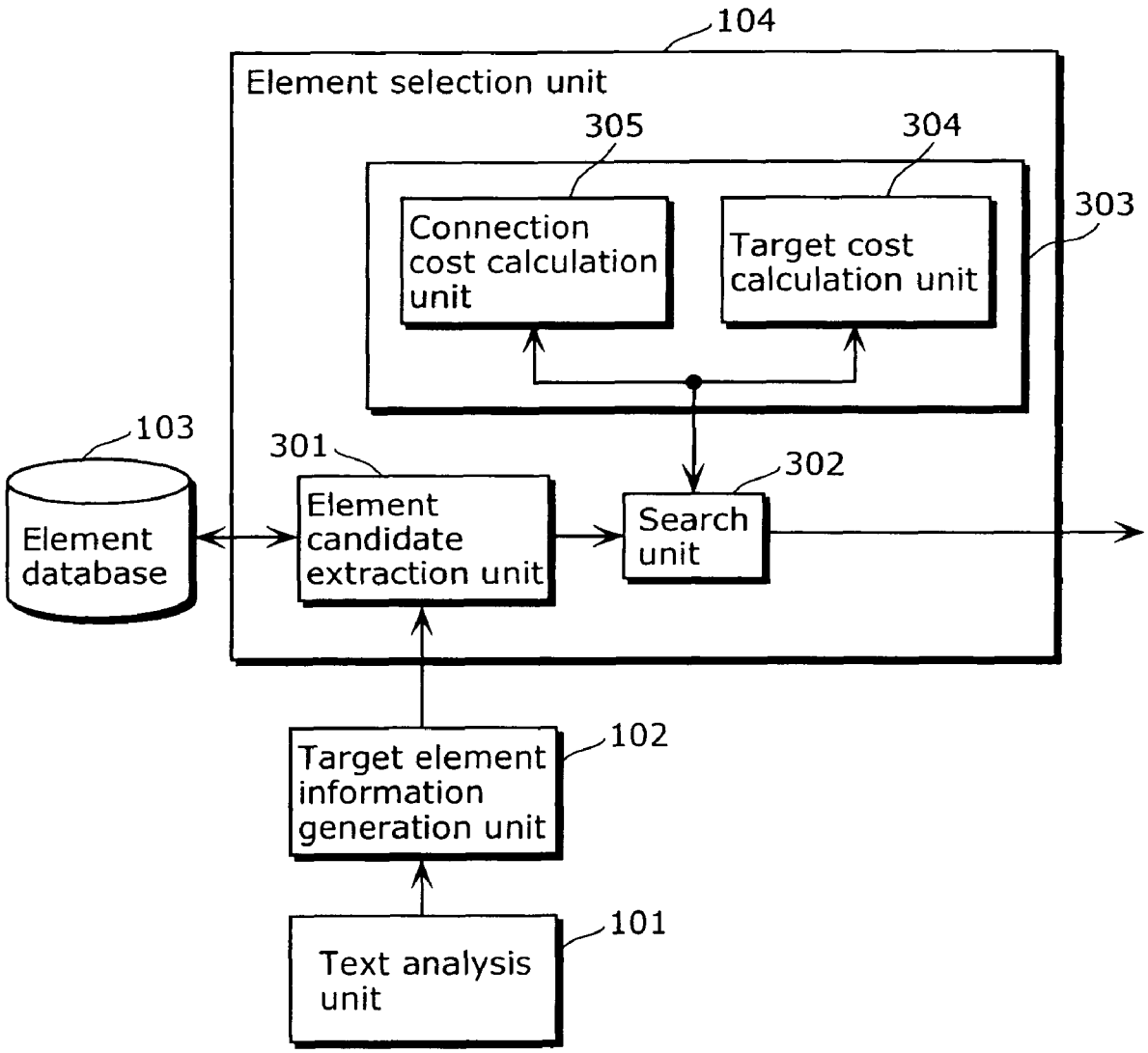
FIG. 2 is a general configuration diagram of an element selection unit.

The element selection unit 104 selects the most suitable speech element sequence from the element database 103 based on the information generated by the target element information generation unit 102. A specific configuration of the element selection unit 104 is not particularly specified, and FIG. 2 shows one example of the configuration.

Descriptions of the units shown in FIG. 1 are not given. The element selection unit 104 includes an element candidate extraction unit 301, a search unit 302, and a cost calculation unit 303.

The element candidate extraction unit 301 is a processing unit that extracts the candidates that have a possibility of being selected from the speech database 103 based on items (for example, phoneme, and the like) relating to phonology from the speech element information generated by the target element information generation unit 102. The search unit 302 is a processing unit that decides the speech element sequence with a minimum cost calculated by the cost calculation unit 303, from the element candidates extracted by the element candidate extraction unit 301.

The cost calculation unit 303 includes a target cost calculation unit 304 that calculates a distance between the element candidate and the speech element information generated by the target element information generation unit 102, and a connection cost calculation unit 304 that evaluates the connectivity when two element candidates are temporally connected.

The speech element sequence that minimizes the cost function expressed by the sum of the target cost and the connection cost is searched by the search unit 302 to obtain the synthesized sound that is similar to the target speech element information and has smooth connection.

<Voice Characteristics Designation Unit 105>

The voice characteristics designation unit 105 accepts a designation on the voice characteristic of the synthesized sound desired by the editor. A specific designation method is not particularly limited, and FIG. 3 shows one example thereof.

Figure 3:
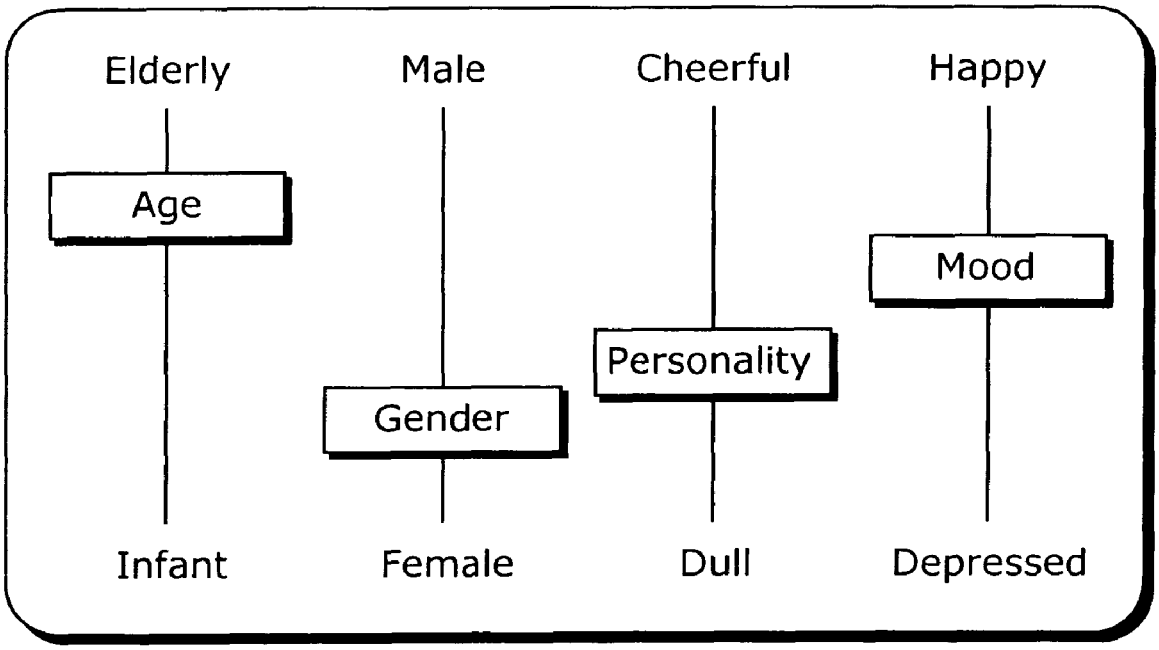
FIG. 3 is a diagram showing one example of a voice characteristics designation unit.

For example, the voice characteristics designation unit 105 is configured by a GUI (Graphical User Interface), as shown in FIG. 3. A slider is arranged with respect to a reference axis (for example, age, gender, emotion, and the like) that can be changed for the voice characteristic of the synthesized sound, and the control value of each reference axis is designated by the position of the slider. The number of reference axes is not particularly limited.

<Voice Characteristics Transformation Unit 106>

The voice characteristics transformation unit 106 transforms the speech element sequence selected by the element selection unit 104 so as to match the voice characteristic designated by the voice characteristics designation unit 105. The method of transformation is not particularly limited.

In the case of the speech synthesis method by LPC (Linear Predictive Coefficient) analysis, there is a method of obtaining the synthesized sound of a different voice characteristic by moving the LPC coefficient with a voice characteristics transformation vector. For example, the movement vector is produced based on the difference between the LPC coefficient of the voice characteristic A and the LPC coefficient of the voice characteristic B, and voice characteristics transformation is realized by transforming the LPC coefficient with the movement vector.

The method of voice characteristics transformation may be realized by expanding and contracting the formant frequency.

<Waveform Generation Unit 107>

The waveform generation unit 107 synthesizes the speech element sequence transformed by the voice characteristics transformation unit 106, and synthesizes a speech waveform. A synthesizing method is not particularly limited. For example, if the speech element stored in the element database 103 is a speech waveform, synthesis may be performed by a waveform connection method. Alternatively, if the information stored in the element database is the sound source wave information and the vocal tract information, re-synthesis may be performed as a source filter model.

<Distortion Determination Unit 108>

The distortion determination unit 108 compares the speech element sequence selected by the element search unit 104 and the speech element sequence with the voice characteristic transformed by the voice characteristics transformation unit 106, and calculates a distortion of the speech element sequence due to the deformation performed by the voice characteristics transformation unit 106. A range in determining the distortion may be any one of a phoneme, a syllable, a mora, a morpheme, a word, a clause, an accent phrase, a breath group, or a whole sentence.

A calculation method of the distortion is not particularly limited, but is broadly divided into a method of calculating from a distortion at a connection boundary of speech elements and a method of calculating based on a degree of deformation of speech elements. Specific examples thereof are as described below.

1. Determination Based on Connectivity of Connection Boundary

Distortion becomes large due to the deformation by the voice characteristics transformation unit 106 in the vicinity of the connection boundary of the speech element. Such phenomenon is obvious when voice characteristics transformation is independently performed for each speech element by the voice characteristics transformation unit 106. The sound quality is degraded in the vicinity of the element connecting point because of such distortion when synthesized sound is synthesized by the waveform generation unit 107. Thus, the distortion at the element connecting point is determined. A determination method includes, for example, the following methods.

1.1 Cepstrum Distance

The distortion is determined by the cepstrum distance representing the shape of a spectrum at the element connecting point. In other words, the cepstrum distance between the final frame of the anterior element of the connecting point and the head frame of the posterior element of the connecting point is calculated.

1.2 Formant Distance

The distortion is determined by the formant continuity at the element connecting point. In other words, the distance is calculated based on the difference between the formant frequency of the final frame of the anterior element of the connecting point and the formant frequency of the head frame of the posterior element of the connecting point.

1.3 Continuity of Pitch

The distortion is determined by the continuity of the fundamental frequency at the element connecting point. In other words, the difference between the fundamental frequency of the final frame of the anterior element of the connecting point and the fundamental frequency of the head frame of the posterior element of the connecting point is calculated.

1.4 Continuity of Power

The distortion is determined by the continuity of power at the element connecting point. In other words, the difference between the power of the final frame of the anterior element of the connecting point and the power of the head frame of the posterior element of the connecting point is calculated.

2. Determination Based on the Degree of Deformation of Elements

In the case where the voice characteristic designated by the voice characteristics designation unit 105 differs greatly from the voice characteristic of the speech element sequence selected by the element selection unit 104 when the selected speech element sequence is deformed by deformation performed by the voice characteristics transformation unit 106, the degree of change in the voice characteristics increases, and the characteristic, particularly, an articulation, of the speech is degraded when synthesized by the waveform generation unit 107. Thus, the distortion is determined based on the degree of deformation obtained by comparing the speech element sequence selected by the element selection unit 104 with the speech element sequence transformed by the voice characteristics transformation unit 106. For example, determination may be performed with the following methods.

2.1 Cepstrum Distance

The distortion is determined based on the cepstrum distance between the speech element sequence before voice characteristics transformation and the speech element sequence after voice characteristics transformation.

2.2 Formant Distance

The distortion is determined based on the distance based on the difference between the formant frequency of the speech element sequence before voice characteristics transformation and the formant frequency of the speech element sequence after voice characteristics transformation.

2.3 Degree of Deformation in Fundamental Frequency

The distortion is determined based on the difference in the average value of the fundamental frequency of the speech element sequence before voice characteristics transformation and the speech element sequence after voice characteristics transformation. Alternatively, the distortion is determined based on the difference in the temporal patterns of the fundamental frequency.

2.4 Degree of Deformation in Power

The distortion is determined based on the difference in the average value of the power of the speech element sequence before voice characteristics transformation and the power of the speech element sequence after voice characteristics transformation. Alternatively, the distortion is determined based on the difference in the temporal patterns of the power.

In the case where the distortion calculated through one of the above methods is greater than a predetermined threshold value, the distortion determination unit 108 instructs the element selection unit 104 and the target element information correction unit 109 to reselect the speech element sequence.

In the case where the distortion is calculated by a combination of above methods and the distortion is greater than a predetermined threshold value, the distortion determination unit 108 may instruct the element selection unit 104 and the target element information correction unit 109 to reselect the speech element information.

<Target Element Information Correction Unit 109>

When the distortion determination unit 108 determines that the speech element is distorted, the target element information correction unit 109 corrects the target element information generated by the target element information generation unit 102 to change the speech element sequence determined as being distorted by the distortion determination unit 108.

Figure 4:
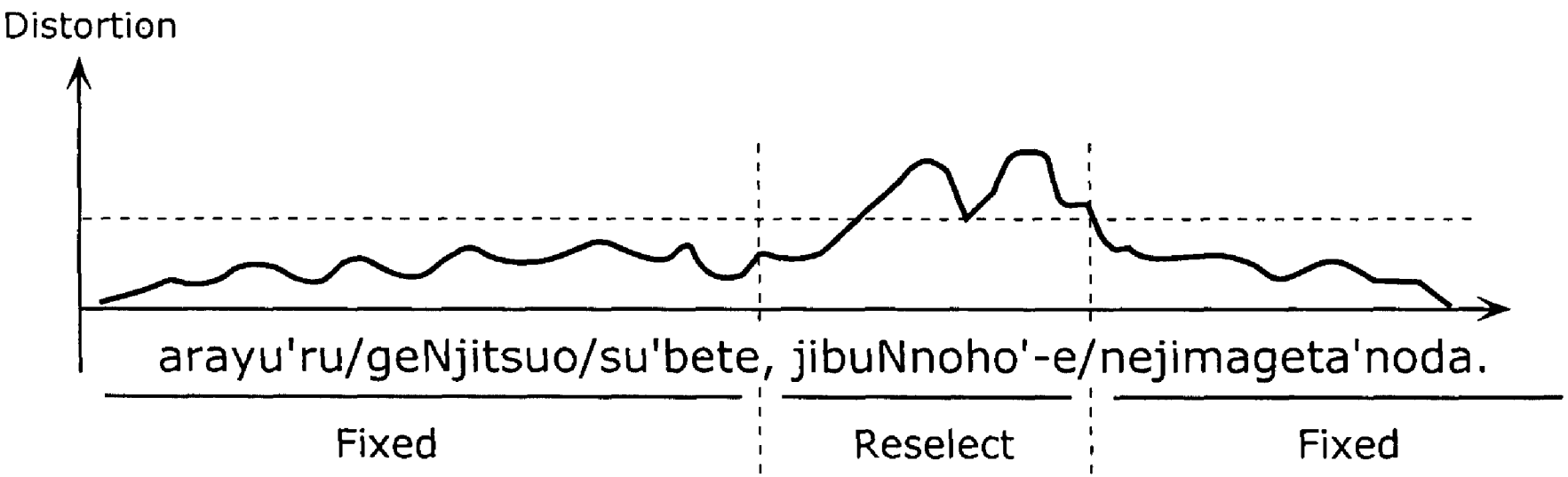
FIG. 4 is an illustration diagram of a range specification of a distortion determination unit.

It shall be described about the operation of the distortion determination unit 108, for example, on the text of "arayu'ru/geNjituso/su'bete,jibuNnoho'-e/nejimageta'noda" of FIG. 4. In the graph shown in FIG. 4, a phoneme sequence is shown in a horizontal axis direction. "'" in the phoneme sequence indicates an accent position. "/" indicates an accent phrase boundary, and "," indicates a pause. The vertical axis shows the degree of distortion of the speech element sequence calculated by the distortion determination unit 108.

The degree of distortion is calculated for each phoneme. The distortion determination is performed with one of the ranges of a phoneme, a syllable, a mora, a morpheme, a word, a clause, an accent phrase, a breath group, or a whole sentence as a unit. In the case where the range of the distortion determination is wider than a phoneme, the distortion of the relevant range is determined by the maximum distortion degree within the range or the average of the distortion degree within the range. In the example of FIG. 4, the accent phrase of "jibuNnoho-e" is the range of determination, and the relevant accent phrase is determined as being distorted since the maximum value of the distortion degree of the phoneme in the range exceeds a predetermined threshold value. In this case, the target element information correction unit 109 corrects the target element information of the relevant range.

Specifically, from the speech element sequence transformed by the voice characteristics transformation unit 106, the fundamental frequency, duration length and power of the relevant speech element are used as the new speech element information.

The formant pattern or the cepstrum pattern, which is the vocal tract information of the speech element sequence after transformation, may be added as the new speech element information to reproduce the voice characteristic transformed by the voice characteristics transformation unit 106.

Furthermore, not only the vocal tract information after transformation, but also the temporal pattern of the fundamental frequency or the temporal pattern of the power serving as the sound source wave information may be added to the speech element information.

The speech element close to the currently set voice characteristic may be designated at the time of reselection by setting the speech element information regarding the voice characteristic that could not be set in the first element selection.

The aspect in the actual operation is described using the operation example in which "ashitano/teNkiwa/haredesu" is is inputted as the inputted text. The text analysis unit 101 performs linguistic analysis on the inputted text. The phoneme sequence of "ashitano/teNkiwa/haredesu" is for example outputted as a result. (Slash represents the break point of the accent phrase.)

The target element information generation unit 102 decides on the targeting speech element information such as phonological environment, fundamental frequency, duration, power, and the like of each phoneme based on the analysis result of the text analysis unit 101. For example, the information where the phonological environment is "^–a+sh" ("^–" indicates that the anterior phoneme is at the front, "+sh" indicates that the posterior phoneme is sh), fundamental frequency is 120 Hz, duration is 60 ms, and power is 200 is outputted as the speech element information for "a" at the front.

The element selection unit 104 selects, from the element database 103, the speech element sequence most suitable for the target element information outputted from the target element information generation unit 102. Specifically, the element candidate extraction unit 301 extracts, from the speech database 103, the speech elements having a matching phonological environment of the speech element information, as the candidate of element selection. The search unit 302 decides on an element candidate sequence having a minimum cost value calculated by the cost calculation unit 303, from among the element candidates extracted by the element candidate extraction unit 301 using Viterbi algorithm and the like. The cost calculation unit 303 includes the target cost calculation unit 304 and the connection cost calculation unit 305, as described above. The target cost calculation unit 304 compares "a" of the speech element information with the speech element information of the candidate, and calculates the matching degree. For example, when the speech element information of the candidate element has the phonological information of "^-a+k", fundamental frequency of 110 Hz, duration of 50 ms, and power of 200, the matching degree is calculated for each speech element information and the numerical value integrating each matching degree is outputted as a target cost value. The connection cost calculation unit 305 evaluates the connectivity in connecting two adjacent speech elements, that is, two speech elements of "a" and "sh" in the above described example, and outputs the result as the connection cost value. In the evaluation method, evaluation may be made, for example, based on the cepstrum distance between the terminating end of "a" and the starting end of "sh".

The editor designates the desired voice characteristic using GUI of the voice characteristics designation unit 105 as shown in FIG. 3. In this case, the voice characteristic in which age is slightly closer to the elderly, gender is closer to female, personality is rather dull, and mood is more or less normal is designated.

The voice characteristics transformation unit 106 transforms the voice characteristic of the speech element sequence into the voice characteristic designated by the voice characteristics designation unit 105.

In this case, when the voice characteristic of the speech element sequence selected by the element selection unit 104 in the initial selection and the voice characteristic designated by the voice characteristics designation unit 105 greatly differ, the degree of change in the speech element sequence to be corrected by the voice characteristics transformation unit 106 increases, and the quality of the synthesized sound such as articulation, and the like is significantly degraded even if the desired voice characteristic is satisfied. When degradation in the sound quality of the synthesized sound is anticipated from the connectivity of "a" and "sh" or the degree of deformation of the element (for example, cepstrum distance between elements) of the speech element "a" selected from the element database and the speech element "a" transformation transformed by the voice characteristics transformation unit 106, for example, the distortion determination unit 108 reselects a speech element sequence most suitable for the current voice characteristic designated by the voice characteristics designation unit 105 from the element database 103. The distortion determining method is not limited to such methods.

In the case of reselection, the target element information correction unit 109 changes the speech element information of the corrected speech element "a" to, for example, fundamental frequency of 110 Hz, duration of 85 ms, and power of 300. Furthermore, the cepstrum coefficient representing the vocal tract feature of the speech element "a" of after voice characteristics transformation and the formant trajectory are newly added. Thus, the information of the voice characteristic that cannot be estimated from the inputted text can be taken into account at the time of element selection.

The element selection unit 104 reselects the most suitable speech element sequence from the element database 103 based on the speech element information corrected by the target element information correction unit 109.

The voice characteristic of the speech element at the time of reselection can be obtained so as to be closer to the voice characteristic of the speech element before the selection is performed can be obtained by reselecting only the elements from which distortion is detected. Therefore, when editing the desired voice characteristic step by step using GUI as shown in FIG. 3, the element of the voice characteristic closer to the voice characteristic of the synthesized sound of the specified voice characteristic can be selected. Therefore, editing can be performed while continuously changing the voice characteristic and the synthesized sound corresponding to the intuition of the editor can be edited.

In this case, the target cost calculation unit 304 calculates a target cost in consideration with the matching degree of the vocal tract feature, which was not taken into consideration in the initial selection. Specifically, the cepstrum distance or the formant distance between the target element "a" and the element candidate "a" is calculated. The speech element that is similar to the current voice characteristic and has a small degree in deformation and high sound quality can thus be selected.

As described above, the voice characteristics transformation unit 106 can always perform voice characteristics transformation based on the most suitable speech element sequence even when the editor sequentially changes the voice characteristic of the synthesized sound with the voice characteristics designation unit 105 by reselecting the speech element sequence in which the amount of change by the voice characteristics transformation unit 106 is small. The voice characteristics variable speech synthesis of high sound quality and with a large variation of voice characteristics can be thus realized.

Figure 5:
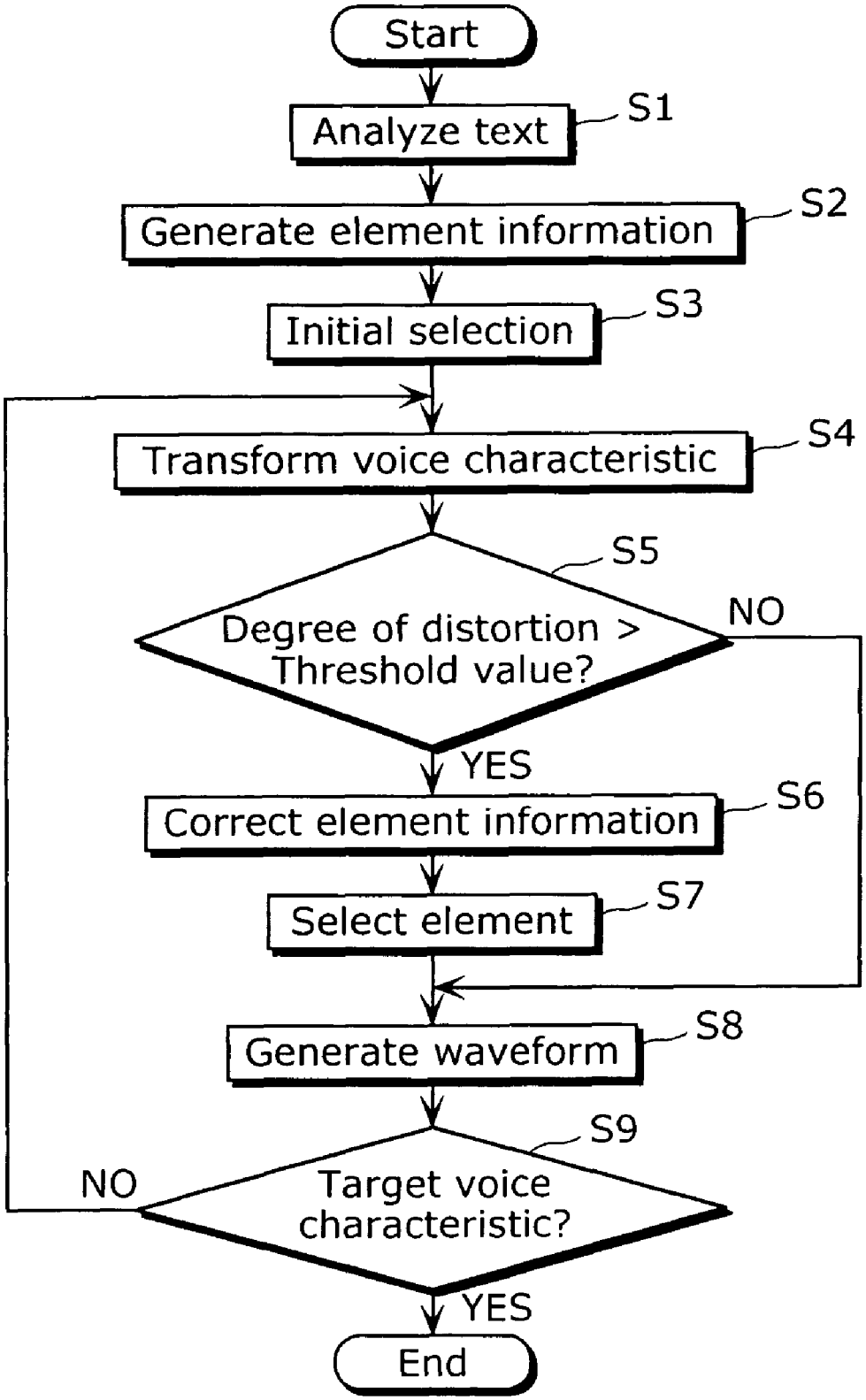
FIG. 5 is a flowchart of a process executed by the voice characteristics variable speech synthesis device.

Processes executed by the voice characteristics variable speech synthesis device 100 when synthesizing the speech of the voice characteristic desired by the editor are described. FIG. 5 is a flowchart illustrating the processes executed by the voice characteristics variable speech synthesis device 100.

The text analysis unit 101 linguistically analyzes the inputted text (S1). The target element information generation unit 102 generates the speech element information such as the fundamental frequency and duration length of each speech element, based on the linguistic information analyzed by the text analysis unit 101 (S2).

The element selection unit 104 selects (S3), from the element database 103, the speech element sequence that most matches the speech element information generated in the element information generating process (S2).

The editor then designates the voice characteristic by the voice characteristics designation unit 105 including GUI as shown in FIG. 3, and the voice characteristics transformation unit 106 transforms the voice characteristic of the speech element sequence selected in the speech element sequence selecting process (S3) based on the designated information (S4).

The distortion determination unit 108 determines whether or not the speech element sequence in which the voice characteristic has been transformed in the voice characteristics transformation process (S4) is distorted (S5). Specifically, the distortion in the speech element sequence is calculated with one of the above methods, and the speech element sequence is determined as distorted if the distortion is greater than the predetermined threshold value.

In the case where the speech element sequence is determined to be distorted (YES in S5), the target element information correction unit 109 corrects the speech element information generated by the target element information generation unit 102 to the speech element information corresponding to the current voice characteristic (S6). The element selection unit 104 then reselects speech elements from the element database 103 (S7) targeting the speech element information corrected in the element information correcting process (S6).

In the case where it is determined that the distortion is not present (NO in S5), or after the speech elements are reselected (S7), the waveform generation unit 107 synthesizes the speech with the selected speech elements (S8).

The editor listens to the synthesized speech, and determines whether or not it is the desired voice characteristic (S9). In the case where it is the desired voice characteristic (YES in S9), the process is terminated. In the case where it is not the desired voice characteristic (NO in S9), the process returns to the voice characteristics transformation process (S4).

The editor can synthesize the speech to have the desired voice characteristic by repeating the voice characteristics transformation process (S4) to the voice characteristics determination process (S9).

The operation of when the editor desires the synthesized sound having the "masculine and cheerful voice characteristic" for text "arayu'ru/genjitsuo,su'bete/jibuNno/ho'-e, nejimageta'noda" shall be described according to the flowchart shown in FIG. 5.

The text analysis unit 101 performs morpheme analysis, determination of reading, determination of clause, modification analysis, and the like (S1). The phoneme sequence of "arayu'ru/genjitsuo,su'bete/jibuNno/ho'-e, nejimageta'noda" is obtained as a result.

The target element information generation unit 102 generates the features of each phoneme such as phonological environment, fundamental frequency, duration length, power, and the like for each phoneme "a", "r", "a", "y", or the like (S2).

The element selection unit 104 selects the most suitable speech element sequence from the element database 103 (S3) based on the speech element information generated in the element information generating process (S2).

The editor designates the target voice characteristic using the voice characteristics designation unit 105 as shown in FIG. 3. For example, the axis of gender is moved to the male side, and the axis of personality is moved to the cheerful side. The voice characteristics transformation unit 106 then transforms the voice characteristic of the speech element sequence based on the voice characteristics designation unit 105 (S4).

The distortion determination unit 108 determines whether or not the speech element sequence in which the voice characteristic has been transformed in the voice transformation process (S4) is distorted (S5). For example, in the case where the distortion is detected (YES in S5) as shown in FIG. 4 by the distortion determination unit 108, the process proceeds to the speech element information correcting process (S6). Furthermore, the process proceeds to the waveform generating process (S8) when the distortion does not exceed a predetermined threshold value (NO in S5) as shown in FIG. 4.

In the speech element information correcting process (S6), the target element information correction unit 109 extracts the speech element information of the speech element sequence in which the voice characteristic is transformed in the voice characteristics transformation process (S4), and corrects the speech element information. In the example of FIG. 4, "jibuNno/ho'-e", which is the accent phrase in which the distortion exceeds the threshold value, is designated as the range for reselection, and the speech element information is corrected.

The element selection unit 104 reselects the speech element sequence that most matches the target element information corrected in the speech element information correcting process (S6), from the element database 103 (S7). Thereafter, the waveform generation unit 107 generates a speech waveform from the speech element sequence in which the voice characteristic has been changed.

The editor listens to the generated speech waveform and determines whether or not it is the target voice characteristic (S9). In the case where it is not the target voice characteristic (NO in S9), for example, when desiring to have a "slightly more masculine voice", the process proceeds to the voice characteristics transformation process (S4), and the editor further shifts the gender axis of the voice characteristics designation unit 105 shown in FIG. 3 towards the male side.

The synthesized sound of the "masculine and cheerful voice characteristic" desired by the editor can be gradually changed through continuous voice characteristics changes by repeating the voice characteristics transformation process (S4) to the voice characteristics judgment process (S9) without degrading the quality of the synthesized sound.

Figure 6:
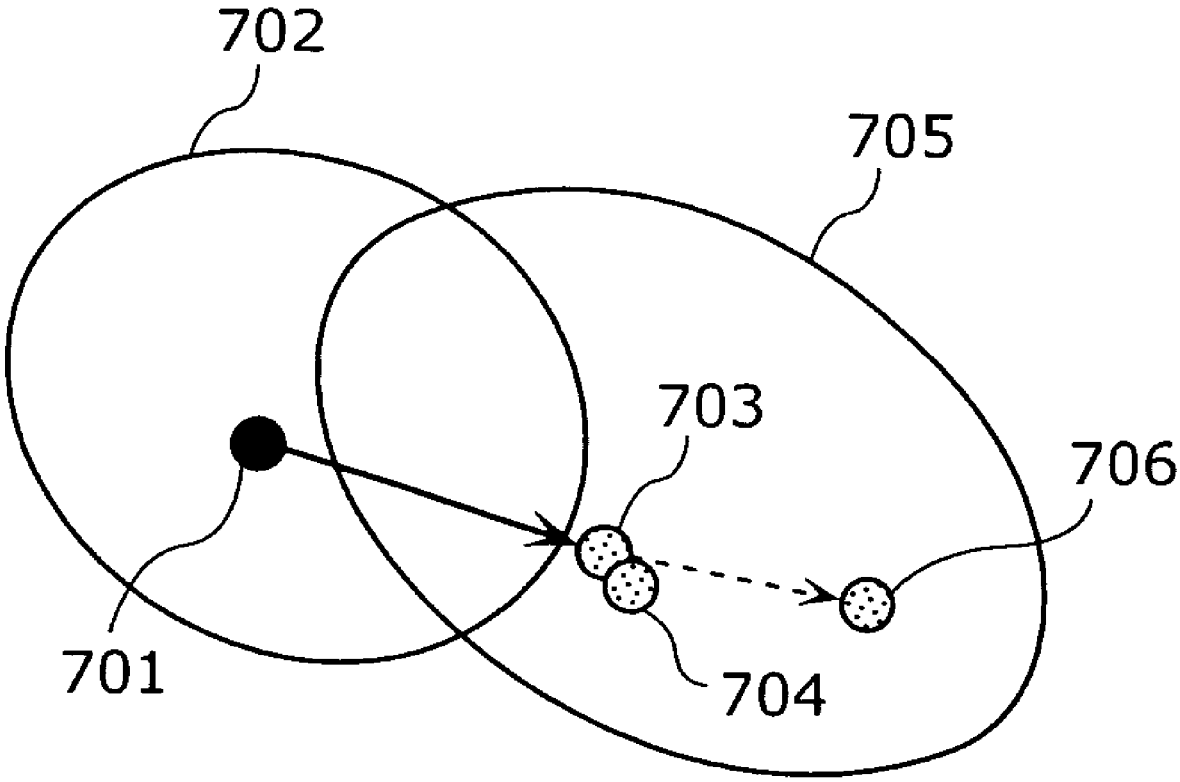
FIG. 6 is an illustration diagram of a voice characteristics transformation process in a voice characteristics space.

FIG. 6 shows an image of the effect of the present invention. FIG. 6 shows a voice characteristics space. The voice characteristics 701 shows the voice characteristic of the element sequence selected in the initial selection. The range 702 shows the range of the voice characteristics that can be voice characteristics transformed without being detected with distortion by the distortion determination unit 108 based on the speech element corresponding to the voice characteristic 701. In the case where the editor designates the voice characteristic 703 using the voice characteristics designation unit 105, the distortion is detected by the distortion determination unit 108. Thus, the element selection unit 104 reselects the speech element sequence close to the voice characteristic 703 from the element database 103. The speech element sequence having the voice characteristic 704 close to the voice characteristic 703 can be thereby selected. The range in which the voice characteristics can be transformed without detecting the distortion by the distortion determination unit 108 from the speech element sequence having the voice characteristic 704 is the interior portion of the range 705. Therefore, the voice characteristics transformation of the voice characteristic to the voice characteristic 706 that could not be achieved without producing a distortion in the prior art now becomes possible by transforming the voice characteristic based on the speech element sequence of the voice characteristic 704. Thus, the speech having the voice characteristic desired by the editor can be synthesized by designating step by step the voice characteristic to be designated by the voice characteristics designation unit 105.

According to this configuration, in the case where the distortion of greater than or equal to the predetermined threshold value is detected by the distortion determination unit 108, the speech element information is corrected by the target element information correction unit 109 and a speech element sequence is reselected by the element selection unit 104, so that the speech element that matches the voice characteristic specified by the voice characteristics designation unit 105 can be reselected from the element database 103. Therefore, when the editor desires the synthesis of the speech of the voice characteristics 703 in the voice characteristics space shown in FIG. 6, for example, the voice characteristics transformation from the speech element sequence of the initially selected voice characteristic 701 to the voice characteristic 703 is not performed, but the voice characteristics transformation from the speech element sequence of the voice characteristic 704 closest to the voice characteristic 703 to the voice characteristic 703 is performed. Therefore, the speech synthesis without distortion and with satisfactory sound quality can be performed since the voice characteristics transformation is always performed based on the most suitable speech element sequence.

Furthermore, in the case where the editor re-designates the desired voice characteristic using the voice characteristics designation unit 105, the process is not resumed from the initial selecting process (S3) of the speech element sequence but the process is resumed from the voice characteristics transformation process (S4) in the flowchart of FIG. 5. Thus, when the editor re-designates the desired voice characteristic from the voice characteristic 703 to the voice characteristic 706 in the voice characteristics space of FIG. 6, for example, the voice characteristics transformation from the speech element sequence of the voice characteristic 701 is not performed again, but the voice characteristics transformation is performed based on the speech element sequence of the voice characteristic 704 used in the voice characteristics transformation to the voice characteristic 703. Assuming that the process is resumed from the initial selecting process (S3) of the speech element, when the editor gradually re-designates the desired voice characteristic, the voice characteristics transformation from the speech element sequence of a completely different voice characteristic to the re-designated voice characteristic is sometimes performed even if the re-designated voice characteristic is closer to the voice characteristic before the re-designation in the voice characteristics space. The speech of the voice characteristic desired by the editor thus may not be easily obtained. However, according to the method of the present embodiment, even in the case where the voice characteristic is re-designated, the speech element sequence used in the voice characteristics transformation becomes the same as the speech element sequence used in the previous voice characteristics transformation if the speech element sequence after the voice characteristics transformation does not cause a distortion. Thus, the voice characteristic of the synthesized sound is continuously changed. Therefore, the voice characteristic can be greatly changed without degrading the sound quality since the voice characteristic is continuously changed.

Second Embodiment

Figure 7:
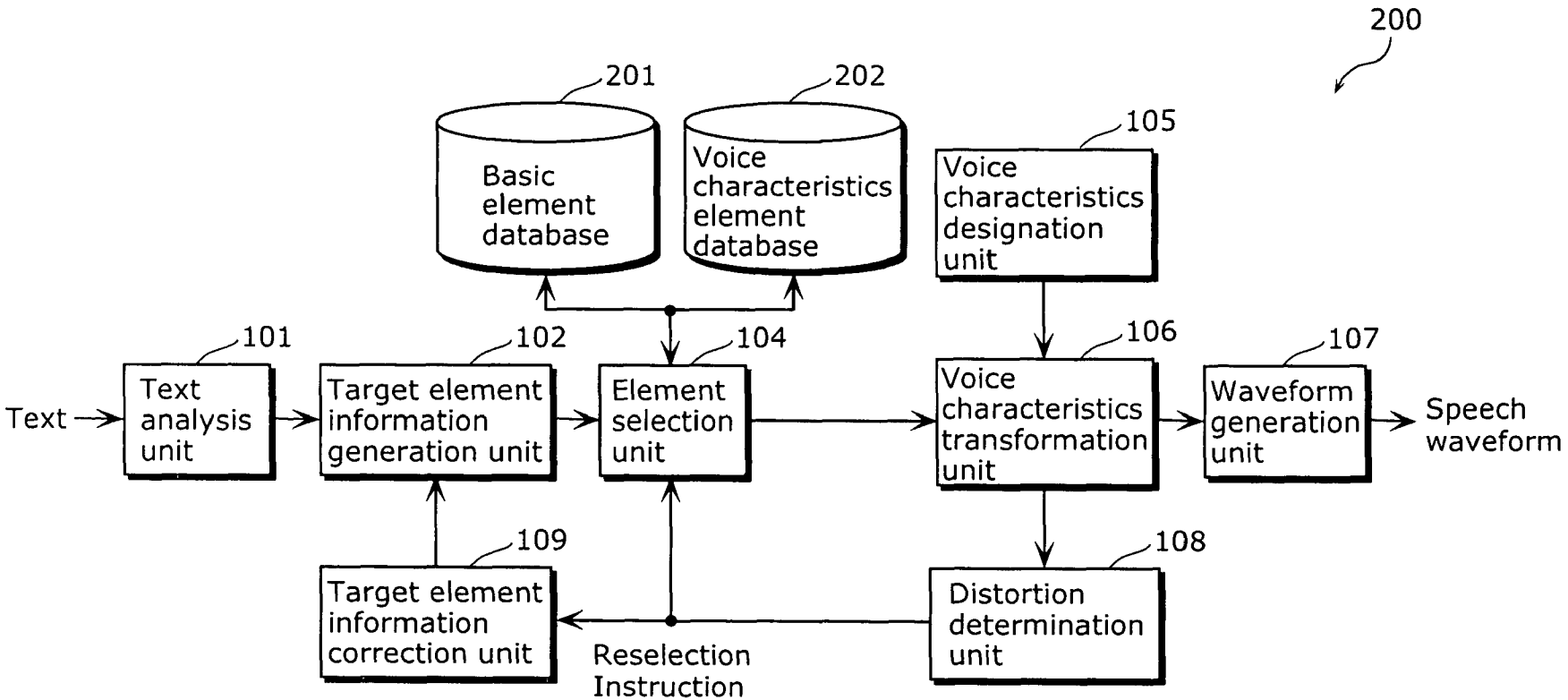
FIG. 7 is a configuration diagram of a voice characteristics variable speech synthesis according to a second embodiment of the present invention.

FIG. 7 is a configuration diagram of a voice characteristics variable speech synthesis device according to a second embodiment of the present invention. In FIG. 7, the same constituent elements as those shown in FIG. 1 are assigned with the same reference numbers, and descriptions thereof are not given.

The voice characteristics variable speech synthesis device 200 shown in FIG. 7 is different from the voice characteristics variable speech synthesis device 100 shown in FIG. 1 in that it uses a basic element database 201 and a voice characteristics element database 202 in place of the element database 103.

The basic element database 201 is a storage unit that stores speech elements to be used for synthesizing a neutral voice characteristic when the voice characteristics designation unit 105 does not designate any voice characteristics. The voice characteristics element database 202 differs from the first embodiment in being configured so as to store the speech elements of abundant voice characteristics variation from which the voice characteristic designated by the voice characteristics designation unit 105 can be synthesized.

In the present embodiment, the element selection unit 104 selects the most suitable speech element sequence from the basic element database 201 based on the speech element information generated by the target element information generation unit 102 in the selection of the first speech element sequence with respect to the inputted text.

The element selection unit 104 reselects the speech element sequence most suited to the corrected speech element information from the voice characteristics element database 202, in the case where the voice characteristics transformation unit 106 transforms the voice characteristic of the speech element sequence to the voice characteristic designated by the voice characteristics designation unit 105, the distortion determination unit 108 detects the distortion, the target element information correction unit 109 corrects the speech element information, and the element selection unit 104 reselects a speech element sequence.

According to the present configuration, since the element selecting unit 104 selects a speech element sequence only from the basic element database configured only with the speech elements of the neutral voice characteristics when generating the synthesized sound of the neutral voice characteristic of before the voice characteristic is designated by the voice characteristics designation unit 105, the time required for an element search can be shortened and the synthesized sound of the neutral voice characteristic can be generated at satisfactory precision.

Whereas the voice characteristics variable speech synthesis device according to the present invention has been described based on the embodiments in the above, the present invention is not limited to such embodiments.

Figure 8:
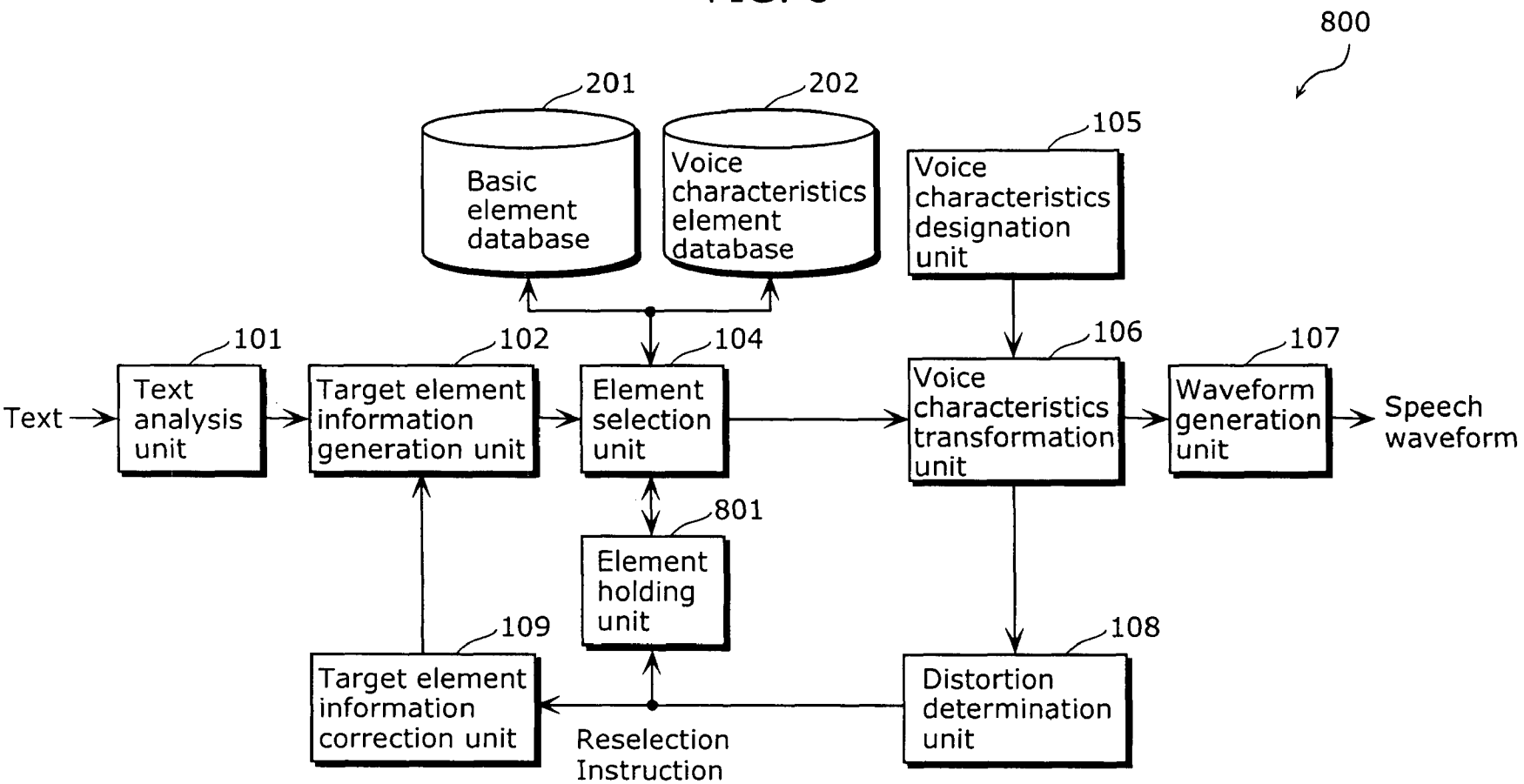
FIG. 8 is an illustration diagram showing when a speech element sequence is reselected.
Figure 9:
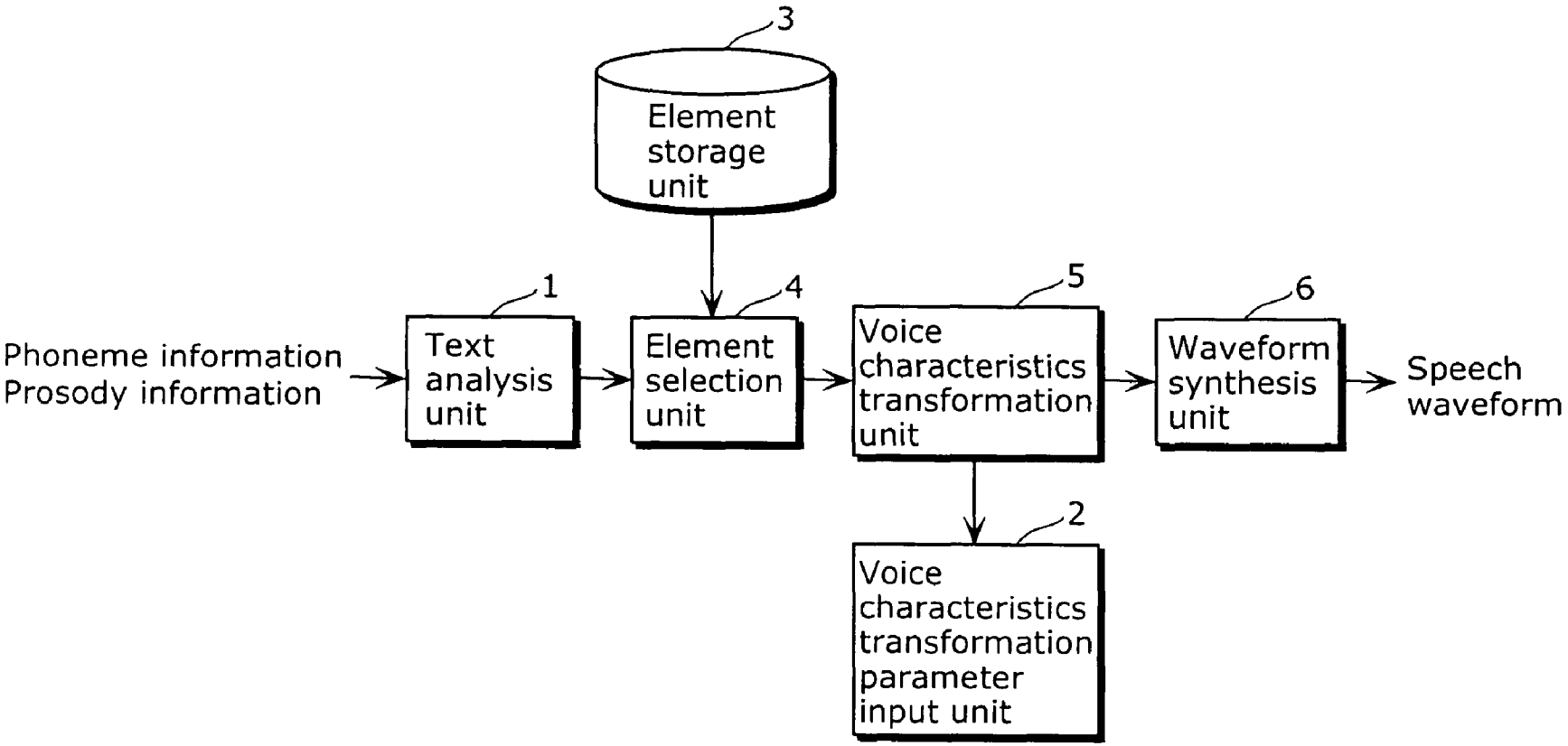
FIG. 9 is a configuration diagram of a conventional voice characteristics variable speech synthesis device.

For example, as shown in FIG. 8, a voice characteristics variable speech synthesis device 800 may be configured so as to include an element holding unit 801 in the voice characteristics variable speech synthesis device 200 shown in FIG. 7. The element holding unit 801 holds an identifier of the element sequence selected by the element selection unit 104. When the element selection unit 104 performs reselection from the element database 103 based on the speech element information corrected by the target element information correction unit 109, only the range in which the speech element sequence is determined to be distorted by the distortion determination unit 108 is targeted for reselection. That is, the element selection unit 104 may be configured to use the element sequence same as the element sequence selected in the previous element selection using an identifier held in the element holding unit 801 for the speech element sequence in the range judged as not being distorted.

The element holding unit 801 may hold the element itself instead of the identifier.

The range of reselection may be any one of a phoneme, a syllable, a mora, a morpheme, a word, a clause, an accent phrase, a breath group, and a whole sentence.

INDUSTRIAL APPLICABILITY

The voice characteristics variable speech synthesis device according to the present invention is useful as a speech synthesis device and the like having a function of performing voice characteristics transformation without lowering the sound quality of the synthesized sound even when the voice characteristic of the synthesized sound is greatly-changed, and generating a response speech for an entertainment or a speech dialogue system.

The invention claimed is:

1. A speech synthesis device which synthesizes a speech having a desired voice characteristic, said device comprising:

a speech element storage unit operable to store speech elements of plural voice characteristics;

a target element information generation unit operable to generate speech element information based on language information including phoneme information;

an element selection unit operable to select, from said speech element storage unit, a speech element sequence corresponding to the speech element information;

a voice characteristics designation unit operable to accept a designation regarding a voice characteristic of a synthesized speech;

a voice characteristics transformation unit operable to transform the speech element sequence selected by said element selection unit into a speech element sequence of the voice characteristic accepted by said voice characteristics designation unit;

a distortion determination unit operable to determine a distortion between the speech element sequence after being transformed by said voice characteristics transformation unit and the speech element sequence before being transformed by said voice characteristics transformation unit; and a target element information correction unit operable to correct the speech element information generated by said target element information generation unit to speech element information corresponding to the speech element sequence after being transformed by said voice characteristics transformation unit, in the case where said distortion determination unit determines that the transformed speech element sequence is distorted, wherein said element selection unit is operable to select, from said speech element storage unit, a speech element sequence corresponding to the corrected speech element information, in the case where said target element information correction unit has corrected the speech element information.

2. The speech synthesis device according to claim 1, wherein said voice characteristics transformation unit is further operable to transform the speech element sequence corresponding to the corrected speech element information into the speech element sequence of the voice characteristic accepted by said voice characteristics designation unit.

3. The speech synthesis device according to claim 1, wherein said target element information correction unit is further operable to add a vocal tract feature of the speech element sequence after being transformed by said voice characteristics transformation unit, to the corrected speech element information, when correcting the speech element information generated by said target element information generation unit.

4. The speech synthesis device according to claim 3, wherein the vocal tract feature is one of a cepstrum coefficient of the speech element sequence after being transformed by said voice characteristics transformation unit and a time pattern of the cepstrum coefficient.

5. The speech synthesis device according to claim 3, wherein the vocal tract feature is one of a formant frequency of the speech element sequence after being transformed by said voice characteristics transformation unit and a time pattern of the formant frequency.

6. The speech synthesis device according to claim 1, wherein said distortion determination unit is operable to determine a distortion based on a connectivity between adjacent speech elements.

7. The speech synthesis device according to claim 6, wherein said distortion determination unit is operable to determine a distortion based on one of the following: a cepstrum distance between the adjacent speech elements; a formant frequency distance between the adjacent speech elements; a fundamental frequency difference between the adjacent speech elements; and a power distance between the adjacent speech elements.

8. The speech synthesis device according to claim 1, wherein said distortion determination unit is operable to determine a distortion based on a degree of deformation between the speech element sequence selected by said element selection unit and the speech element sequence after being transformed by said voice characteristics transformation unit.

9. The speech synthesis device according to claim 8, wherein said distortion determination unit is operable to determine a distortion based on one of the following: a cepstrum distance between the speech element sequence selected by said element selection unit and the transformed speech element sequence; a formant frequency distance between the speech element sequence selected by said element selection unit and the transformed speech element sequence; a fundamental frequency difference between the speech element sequence selected by said element selection unit and the transformed speech element sequence; and a power difference between the speech element sequence selected by said element selection unit and the transformed speech element sequence.

10. The speech synthesis device according to claim 1, wherein said distortion determination unit is operable to determine a distortion by a unit of phoneme, syllable, mora, morpheme, word, clause, accent phrase, phrase, breath group, or whole sentence.

11. The speech synthesis device according to claim 1, wherein said element selection unit is operable to select, from said speech element storage unit, the speech element sequence corresponding to the corrected speech element information, only with respect to a range in which the distortion is detected by said distortion determination unit, in the case where said target element information correction unit has corrected the speech element information.

12. The speech synthesis device according to claim 11 further comprising an element holding unit operable to hold an identifier of the speech element sequence selected by said element selection unit, wherein said element selection unit is operable to select the speech element sequence based on the identifier held by said element holding unit, with respect to the speech element sequence in a range in which the distortion is not detected by said distortion determination unit.

13. The speech synthesis device according to claim 1, wherein said speech element storage unit includes:

a basic speech element storage unit operable to store a speech element of a standard voice characteristic;

a voice characteristics speech element storage unit operable to store speech elements of plural voice characteristics, the speech elements being different from the speech element of the standard voice characteristic, said element selection unit includes:

a basic element selection unit operable to select, from said basic speech element storage unit, a speech element sequence corresponding to the speech element information generated by said target element information generation unit; and a voice characteristics element selection unit operable to select, from said voice characteristics speech element storage unit, the speech element sequence corresponding to the speech element information corrected by said target element information correction unit.

14. A speech synthesis method for use in a speech synthesis device including a speech element storage unit for storing speech elements of plural voice characteristics, said method comprising:

a target element information generation step of generating speech element information based on language information including phoneme information;

an element selection step of selecting, from the speech element storage unit, a speech element sequence corresponding to the speech element information;

a voice characteristics designation step of accepting a designation regarding a voice characteristic of a synthesized speech;

a voice characteristics transformation step of transforming the speech element sequence selected in said element selection step into a speech element sequence of the voice characteristic accepted in said voice characteristics designation step;

a distortion determination step of determining a distortion between the speech element sequence after being transformed in said voice characteristics transformation step and the speech element sequence before being transformed in said voice characteristics transformation step; and a target element information correction step of correcting the speech element information generated in said target element information generation step to speech element information corresponding to the speech element sequence after being transformed in said voice characteristics transformation step, in the case where it is determined that the transformed speech element sequence is distorted in said distortion determination step, wherein in said element selection step, a speech element sequence corresponding to the corrected speech element information is selected from the speech element storage unit in the case where the speech element information has been corrected in said target element information correction step.

15. A non-transitory computer-readable recording medium on which a program to be executed by a computer is recorded, wherein the computer includes a speech element storage unit for storing speech elements of plural voice characteristics, and the program, when executed by the computer, causes the computer to function as:

a target element information generation unit operable to generate speech element information based on language information including phoneme information;

an element selection unit operable to select, from said speech element storage unit, a speech element sequence corresponding to the speech element information;

a voice characteristics designation unit operable to accept a designation regarding a voice characteristic of a synthesized speech;

a voice characteristics transformation unit operable to transform the speech element sequence selected by said element selection unit into a speech element sequence of the voice characteristic accepted by said voice characteristics designation unit;

a distortion determination unit operable to determine a distortion between the speech element sequence after being transformed by said voice characteristics transformation unit and the speech element sequence before being transformed by said voice characteristics transformation unit; and a target element information correction unit operable to correct the speech element information generated by said target element information generation unit to speech element information corresponding to the speech element sequence after being transformed by said voice characteristics transformation unit, in the case where said distortion determination unit determines that the transformed speech element sequence is distorted, wherein said element selection unit is operable to select, from said speech element storage unit, a speech element sequence corresponding to the corrected speech element information, in the case where said target element information correction unit has corrected the speech element information.

* * * * *